US008925422B2

(12) United States Patent
Lockwood et al.

(10) Patent No.: US 8,925,422 B2
(45) Date of Patent: Jan. 6, 2015

(54) METHOD OF MANUFACTURING A DRILL BIT

(75) Inventors: Gregory T. Lockwood, Pearland, TX (US); Youhe Zhang, Spring, TX (US); Yuelin Shen, Houston, TX (US)

(73) Assignee: Smith International, Inc., Houston, TX (US)

( * ) Notice: Subject to any disclaimer, the term of this patent is extended or adjusted under 35 U.S.C. 154(b) by 564 days.

(21) Appl. No.: 12/964,827

(22) Filed: Dec. 10, 2010

(65) Prior Publication Data

US 2011/0174114 A1 Jul. 21, 2011

Related U.S. Application Data

(62) Division of application No. 12/121,575, filed on May 15, 2008, now Pat. No. 7,878,275.

(51) Int. Cl.

| | |
|---|---|
| ***B21K 5/04*** | (2006.01) |
| ***E21B 10/42*** | (2006.01) |
| ***C22C 29/08*** | (2006.01) |
| ***C22C 29/06*** | (2006.01) |
| ***E21B 10/55*** | (2006.01) |
| ***C22C 1/05*** | (2006.01) |
| *B22F 5/00* | (2006.01) |

(52) U.S. Cl.

CPC ..... *E21B 10/42* (2013.01); *C22C 29/08* (2013.01); *B22F 2005/002* (2013.01); *C22C 29/06* (2013.01); *E21B 10/55* (2013.01); *C22C 1/051* (2013.01)

USPC ..... 76/108.2

(58) Field of Classification Search

USPC ..... 175/374, 425, 393, 434; 76/108.1–108.6; 419/4, 5, 9, 27, 28; 264/125

See application file for complete search history.

(56) References Cited

U.S. PATENT DOCUMENTS

| | | | | |
|---|---|---|---|---|
| 3,757,878 | A | 9/1973 | Wilder et al. | |
| 4,694,919 | A | 9/1987 | Barr | |
| 4,723,996 | A | 2/1988 | Brunet et al. | |
| 4,804,049 | A | 2/1989 | Barr | |
| 4,884,477 | A | 12/1989 | Smith et al. | |
| 4,884,777 | A | 12/1989 | Sakamoto | |
| 4,991,670 | A | 2/1991 | Fuller et al. | |
| 5,000,273 | A * | 3/1991 | Horton et al. | 76/108.2 |
| 5,089,182 | A | 2/1992 | Findeisen et al. | |
| 5,090,491 | A | 2/1992 | Tibbitts et al. | |

(Continued)

FOREIGN PATENT DOCUMENTS

WO 2009140123 A2 11/2009

OTHER PUBLICATIONS

Examination Report filed in correspondence with UK Application No. GB1019568.3 filed Mar. 15, 2012 (2 pages).

(Continued)

*Primary Examiner* — Jason Daniel Prone

(74) *Attorney, Agent, or Firm* — Osha Liang LLP

(57) ABSTRACT

A method of manufacturing a drill bit having a bit body and a plurality of blades extending radially from the bit body is disclosed, wherein the method includes adhering a first matrix material to at least a portion of a mold cavity corresponding to an outer surface of the bit body, loading a second matrix material into the other portions of the mold cavity, and heating the mold contents to form a matrix body drill bit.

15 Claims, 6 Drawing Sheets

(56) References Cited

U.S. PATENT DOCUMENTS

| | | | | |
|---|---|---|---|---|
| 5,373,907 | A | 12/1994 | Weaver | |
| 5,967,248 | A | 10/1999 | Drake et al. | |
| 6,095,265 | A | 8/2000 | Alsup | |
| 6,209,420 | B1 * | 4/2001 | Butcher et al. | 76/108.2 |
| 6,551,551 | B1 * | 4/2003 | Gegel et al. | 419/9 |
| 7,350,599 | B2 | 4/2008 | Lockwood et al. | |
| 7,878,275 | B2 * | 2/2011 | Lockwood et al. | 76/108.2 |
| 8,109,177 | B2 * | 2/2012 | Kembaiyan | 76/108.1 |
| 8,211,203 | B2 * | 7/2012 | Sheng et al. | 175/374 |
| 8,342,268 | B2 * | 1/2013 | Lockstedt et al. | 175/374 |
| 8,347,990 | B2 * | 1/2013 | Lockwood et al. | 76/108.2 |
| 2003/0029642 | A1 | 2/2003 | Dykstra et al. | |
| 2004/0244540 | A1 | 12/2004 | Oldham et al. | |
| 2004/0245024 | A1 | 12/2004 | Kembaiyan | |
| 2005/0183892 | A1 | 8/2005 | Oldham et al. | |
| 2006/0032335 | A1 * | 2/2006 | Kembaiyan | 76/108.1 |
| 2006/0231293 | A1 | 10/2006 | Ladi et al. | |
| 2007/0017160 | A1 | 1/2007 | Caldwell et al. | |
| 2007/0107942 | A1 | 5/2007 | Overstreet et al. | |
| 2008/0164070 | A1 | 7/2008 | Keshavan et al. | |
| 2009/0260893 | A1 | 10/2009 | Sheng et al. | |
| 2010/0206639 | A1 * | 8/2010 | Lockwood | 175/374 |
| 2010/0206640 | A1 * | 8/2010 | Lockwood et al. | 76/108.2 |
| 2011/0000718 | A1 * | 1/2011 | Bankes et al. | 76/108.2 |
| 2011/0114394 | A1 * | 5/2011 | Lockwood et al. | 175/425 |
| 2011/0120781 | A1 * | 5/2011 | Lockwood et al. | 175/425 |

OTHER PUBLICATIONS

Examination Report issued in corresponding British Application No. 1222451.5 dated Jan. 11, 2013 (2 pages).

Office Action issued in related U.S. Appl. No. 12/621,402; Dated Jan. 20, 2012 (13 pages).

International Search Report and Written Opinion of the International Searching Authority for International Application No. PCT/US2009/043062, mailed on Nov. 25, 2009 (12 pages).

Final Office Action issued in related U.S. Appl. No. 12/121,575 dated May 10, 2010 (14 pages).

"Pliable Optimized Wear—POW"; The DiaPac Group, Jan. 1, 2009 (1 Page).

"Pliable Optimized Wear—POW"; The DiaPac Group, Feb. 2, 2009 (1 Page).

* cited by examiner

METHOD OF MANUFACTURING A DRILL BIT

CROSS-REFERENCE TO RELATED APPLICATIONS

This patent application is a divisional patent application of U.S. patent application Ser. No. 12/121,575, now U.S. Pat. No. 7,878,275, filed on May 15, 2008, which is herein incorporated by reference in its entirety.

BACKGROUND OF INVENTION

1. Field of the Invention

Embodiments disclosed herein relate generally to matrix body drill bits and the methods for the manufacture of such drill bits. In particular, embodiments disclosed herein relate generally to use of multiple matrix materials in a bit.

2. Background Art

Various types and shapes of earth boring bits are used in various applications in the earth drilling industry. Earth boring bits have bit bodies which include various features such as a core, blades, and pockets that extend into the bit body or roller cones mounted on a bit body, for example. Depending on the application/formation to be drilled, the appropriate type of drill bit may be selected based on the cutting action type for the bit and its appropriateness for use in the particular formation. In PDC bits, polycrystalline diamond compact (PDC) cutters are received within the bit body pockets and are typically bonded to the bit body by brazing to the inner surfaces of the pockets. Bit bodies are typically made either from steel or from a tungsten carbide matrix bonded to a separately formed reinforcing core made of steel.

Matrix bit bodies are typically formed of a single, relatively homogenous composition throughout the bit body. The single composition may constitute either a single matrix material such as tungsten carbide or a mixture of matrix materials such as different forms of tungsten carbide. The matrix material or mixture thereof, is commonly bonded into solid form by fusing a metallic binder material and the matrix material or mixture.

The drill bit formation process typically includes placing a matrix powder in a mold. The mold is commonly formed of graphite and may be machined into various suitable shapes. Displacements are typically added to the mold to define the pockets. The matrix powder may be a powder of a single matrix material such as tungsten carbide, or it may be a mixture of more than one matrix material such as different forms of tungsten carbide. The matrix powder may include further components such as metal additives. Metallic binder material is then typically placed over the matrix powder. The components within the mold are then heated in a furnace to the flow or infiltration temperature of the binder material at which the melted binder material infiltrates the tungsten carbide or other matrix material. The infiltration process that occurs during sintering (heating) bonds the grains of matrix material to each other and to the other components to form a solid bit body that is relatively homogenous throughout. The sintering process also causes the matrix material to bond to other structures that it contacts, such as a metallic blank which may be suspended within the mold to produce the aforementioned reinforcing member. After formation of the bit body, a protruding section of the metallic blank may be welded to a second component called an upper section. The upper section typically has a tapered portion that is threaded onto a drilling string. The bit body typically includes blades which support the PDC cutters which, in turn, perform the cutting operation. The PDC cutters are bonded to the body in pockets in the blades, which are cavities formed in the bit for receiving the cutting elements.

The matrix material or materials determine the mechanical properties of the bit body (in addition to being partly affected by the binder material used). These mechanical properties include, but are not limited to, transverse rupture strength (TRS), toughness (resistance to impact-type fracture), hardness, wear resistance (including resistance to erosion from rapidly flowing drilling fluid and abrasion from rock formations), steel bond strength between the matrix material and steel reinforcing elements, such as a steel blank, and strength of the bond to the cutting elements, i.e., braze strength, between the finished body material and the PDC cutter. Abrasion resistance represents another such mechanical property.

According to conventional drill bit manufacturing, a single matrix powder is selected in conjunction with the binder material, to provide desired mechanical properties to the bit body. The single matrix powder is packed throughout the mold to form a bit body having the same mechanical properties throughout. It would, however, be desirable to optimize the overall structure of the drill bit body by providing different mechanical properties to different portions of the drill bit body, in essence tailoring the bit body. For example, wear resistance is especially desirable at regions around the cutting elements and throughout the outer surface of the bit body while high strength and toughness are especially desirable at the bit blades and throughout the bulk of the bit body. However, unfortunately, changing a matrix material to increase wear resistance usually results in a loss in toughness, or vice-versa.

Further, in packing the matrix powder materials into the mold, the geometry of the bit (and thus mold) make it difficult to place different matrix materials in different regions of a bit because there is little or no control over powder locations in the mold during assembly, particularly around curved surfaces. According to the conventional art, the choice of the single matrix powder represents a compromise, as it must be chosen to produce one of the properties that are desirable in one region, generally at the expense of another property or properties that may be desirable in another region.

Accordingly, there exists a continuing need for developments in matrix bit bodies to improve wear resistance and toughness in the regions of the bit in which these properties are desirable.

SUMMARY OF INVENTION

In one aspect, embodiments disclosed herein relate to a drill bit that includes a bit body having a plurality of blades extending radially therefrom, the bit body comprising a first matrix region and a second matrix region, wherein the first matrix region is formed from a moldable matrix material; and at least one cutting element for engaging a formation disposed on at least one of the plurality of blades.

In another aspect, embodiments disclosed herein relate to drill bit that includes a bit body having a plurality of blades extending radially therefrom, at least one of the plurality of blades comprising a first matrix region and a second matrix region, the first matrix region forming at least a portion of the outer surface of the at least one blade and having a thickness variance of less than about ±20%; and at least one cutting element for engaging a formation disposed on at least one of the plurality of blades.

In another aspect, embodiments disclosed herein relate to a drill bit that includes a bit body having a plurality of blades extending radially therefrom, at least one of the plurality of blades comprising a first matrix region and a second matrix region, wherein the first matrix region extends along at least a portion of a sidewall of a blade and the second matrix region forms a core of the blade adjacent an inner periphery of the first matrix region; and at least one cutting element for engaging a formation disposed on at least one of the plurality of blades.

In yet another aspect, embodiments disclosed herein relate to a method of manufacturing a drill bit including a bit body and a plurality of blades extending radially from the bit body that includes adhering a first matrix material to at least a portion of a mold cavity corresponding to an outer surface of the bit body; loading a second matrix material into the other portions of the mold cavity; and heating the mold contents to form a matrix body drill bit.

In yet another aspect, embodiments disclosed herein relate to a method of manufacturing a drill bit including a bit body and a plurality of blades extending radially from the bit body that includes loading a first matrix material of controlled thickness in at least a portion of a mold cavity corresponding to a sidewall of at least one blade; loading a second matrix material into the other portions of the mold cavity; and heating the mold contents to form a matrix body drill bit.

Other aspects and advantages of the invention will be apparent from the following description and the appended claims.

DETAILED DESCRIPTION

In one aspect, embodiments disclosed herein relate to matrix body drill bits and the methods of manufacturing and using the same. More particularly, embodiments disclosed herein relate to PDC drill bits having tailored material compositions allowing for extension of their use downhole. Specifically, embodiments disclosed herein relate to PDC drill bits having blades with harder and softer matrix materials in selection regions of the blade.

Figure 1:
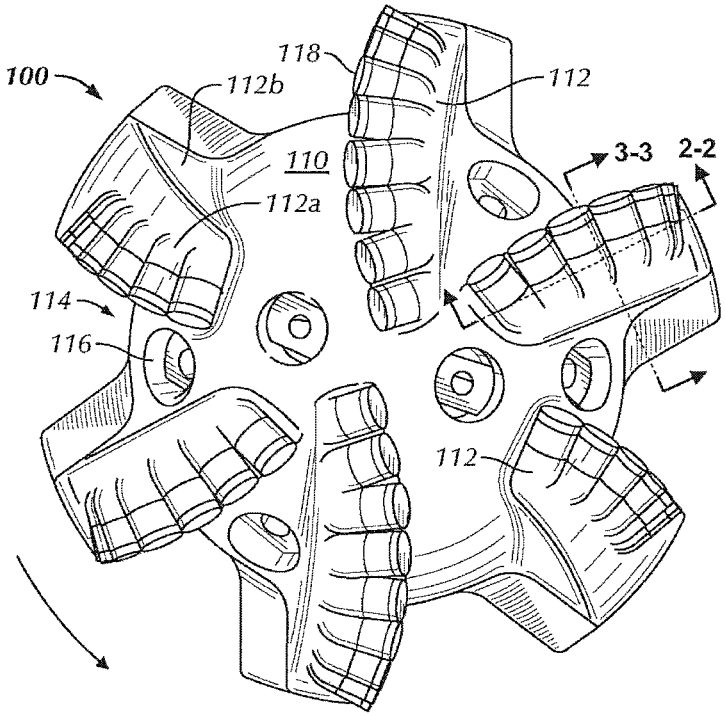
FIG. 1 is a drill bit in accordance with one embodiment.

Referring to FIG. 1, a drill bit in accordance with one embodiment is shown. As shown in FIG. 1, bit 100 includes a bit body 110 and a plurality of blades 112 that are extending from the bit body 110. Blades 112 may extend from a center of the bit body 110 radially outward to the outer diameter of the bit body 110, and then axially downward, to define the diameter (or gage) of the bit 100. A plurality of cutters 118 are received by cutter pockets (not shown separately) formed in blades 112. The blades 112 are separated by flow passages 114 that enable drilling fluid to flow from nozzles or ports 116 to clean and cool the blades 112 and cutters 118.

In a conventional matrix bit, such as formed by infiltrating techniques, a matrix material mixture of hard particles and binder particles are poured into the blade portions (and a portion of the interior bit body), a softer, machinable powder is typically poured on top of the matrix material mixture, and the bit is infiltrated with an infiltration binder. Thus, while it might be desirable to have harder or tougher materials in certain areas to prevent premature failure due to the particular condition experienced by that region of the bit body, such as cracking, erosion, etc., because the materials are powders, there is little or no controllability over the resulting placement of the powder materials within a bit. However, in accordance with the present disclosure, a moldable material may be used in place of at least a portion of conventional powder materials so that particular regions of a matrix body may be formed to have a material composition harder or tougher than the remaining portions of the bit body. Examples of such regions which may be formed of such materials include any outer surface of the bit or surrounding any bit components, including blade tops, sidewalls, bit body exterior, regions surrounding nozzles or ports, regions surrounding cutters, as part of the cutter pocket, etc. However, there is no limitation on the number or types of regions of the bit body which may be formed of such materials.

Figure 2:
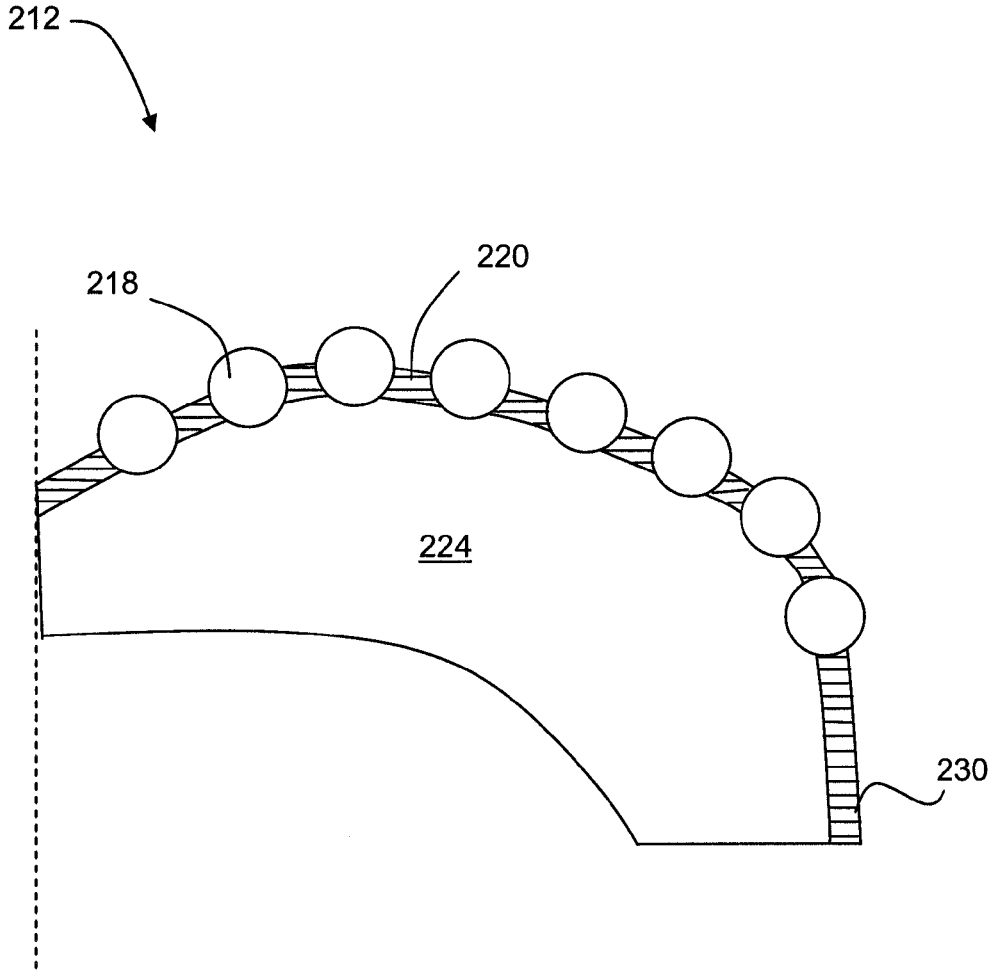
FIG. 2 shows a cross-sectional view of a blade along 2-2 of the bit of FIG. 1.

For example, as shown in FIG. 2, the upper surface of blade 212 (or blade top 112*a* shown in FIG. 1) may form a first matrix region 220 (which interposes cutters 218 as shown in this cross-sectional view), whereas the inner core of the blade 212 forms a second matrix region 224. In such an embodiment, it may be desirable to apply a matrix material for the first matrix region 220 to have greater hardness/wear and erosion resistance as compared to second matrix region 224, where toughness is desired. While toughness and strength are desirable for durability, a wear/erosion resistant exterior is desirable to prevent premature wear and erosion of the bit body material, especially on areas surrounding cutters 218.

Figure 3A:
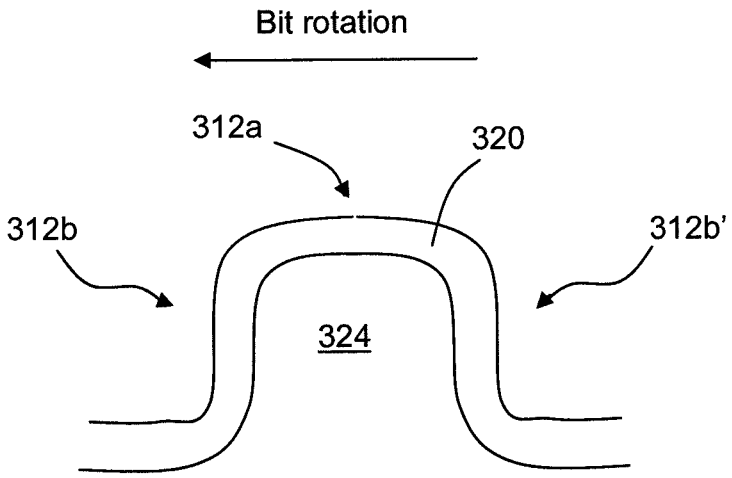
FIGS. 3A-D shows cross-sectional views of various embodiments of a blade along 3-3 of the bit of FIG. 1.
Figure 3B:
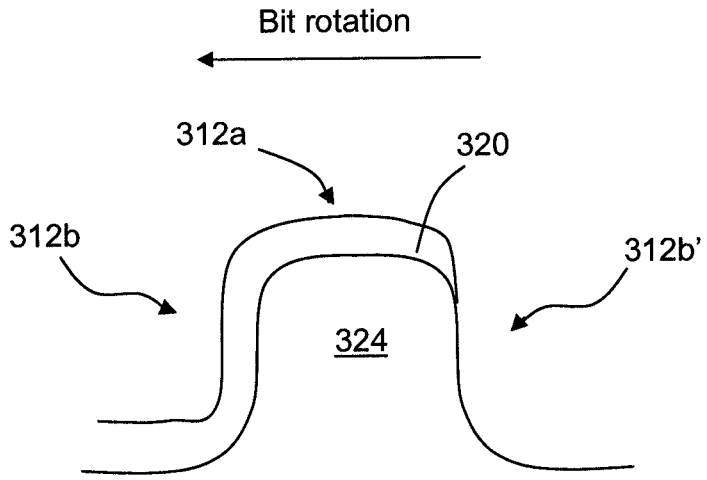
Figure 3C:
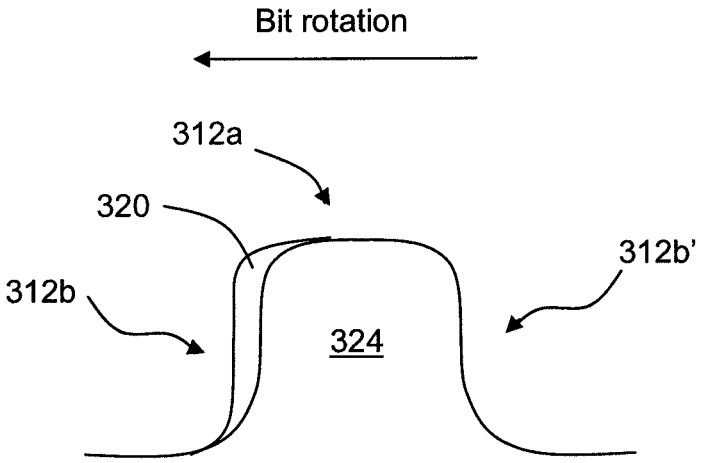
Figure 3D:
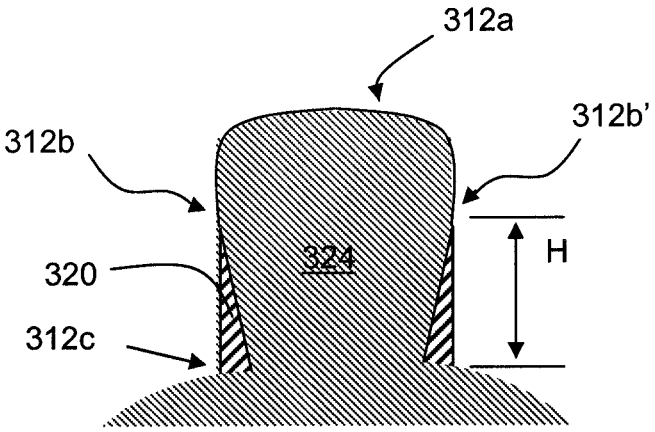

In addition to a first matrix region being along a blade top (112*a* in FIG. 1), as shown in FIGS. 3A-D, various embodiments may provide for first matrix region 320 to be placed on at least a portion of blade tops (112*a* in FIG. 1) and/or blade sidewalls (112*b* in FIG. 1). Specifically, as shown in FIG. 3A, first matrix region 320 may occupy blade top 312*a* and both the leading 312*b* and trailing 312*b*' sidewalls, which are determined by the direction in which the bit rotates downhole. One skilled in the art would appreciate that a leading edge 312*b* or sidewall is the edge of the blade which faces the direction of rotation of the bit, whereas the trailing edge 312*b*' is the edge of the blade that does not face the direction of rotation of the bit. Within the core or inner region of the blade, for example, adjacent an inner periphery of first matrix region 320 is second matrix region 324. However, other variations may also be within the scope of the present disclosure. For example, as shown in FIG. 3B, first matrix region 320 forms blade top 312*a* and leading blade sidewall 312*b*, but second matrix region 324 forms the inner core and leading sidewall 312*b*' of blade 312. Further, as shown in FIG. 3C, only leading sidewall 312*b* is formed of first matrix region 320, and blade top and 312*a* and trailing sidewall 312*b*'. Additionally, first matrix region forming a blade sidewall need not extend the entire height of a blade. As shown in FIG. 3D, first matrix region extends a selected height H from a base of blade 312*c* (where blade 312 extends from bit body (not shown separately)) along the leading and trailing sidewalls 312*b*, 312*b*'.

The effect of such embodiments is a harder exterior on a tougher supporting material, similar to an applied hardfacing layer, such as disclosed in U.S. patent application Ser. No. 11/650,860, which is assigned to the present assignee and herein incorporated by reference. However, unlike a hardfacing, the layer or matrix region having the greater wear resistance is intergrally formed with the remainder of the bit body, sharing common binder material, and thus bonds between binder material. Further, as discussed below in greater detail, the methods and materials may also allow for precision/controllability in the layer thickness.

Additionally, while only a single outer matrix region is shown in these embodiments, it is also within the scope of the present disclosure that multiple gradient layers of matrix materials may be used. Thus, for example, first matrix region may be divided into multiple matrix regions to transition from harder to tougher materials to minimize issues concerning strength and integrity as well as formation of stresses within the bit body.

Figure 4A:
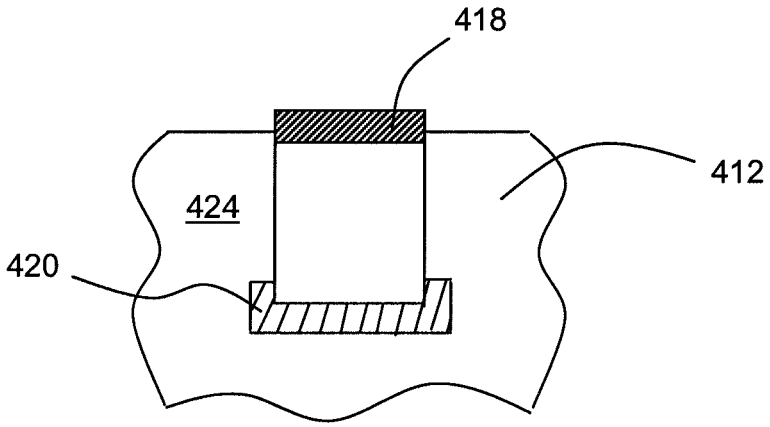
FIGS. 4A-B shows various cross-sectional views of a blade through a cutter.
Figure 4B:
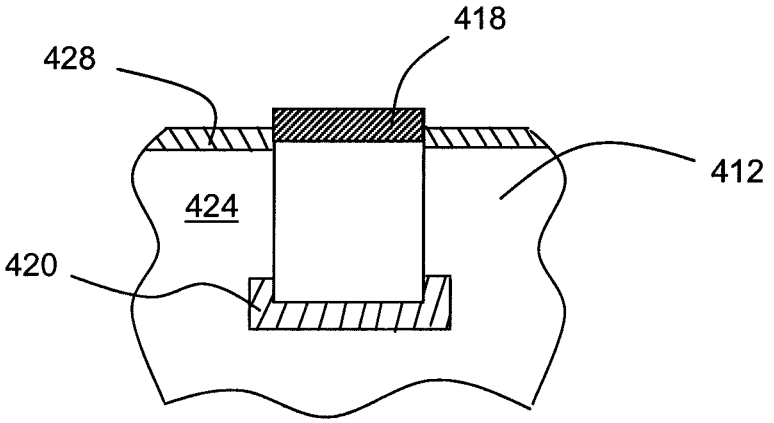

In another embodiment, multiple matrix regions may be used so that at least a portion of the area surrounding cutters may be independently selected for desirable material properties. For example, as shown in FIG. 4A, the base (or non leading face) of cutter 418 is surrounded by a first matrix region 420 unique as compared to second matrix region 424 forming the remainder of blade 412. In a particular embodiment, first matrix region 420 supporting base of cutter 418 may be designed to have a greater toughness than other regions of blade 412, which may be desirable to prevent cracking which frequently occurs behind cutters due to the heavy forces on cutters during drilling. However, one skilled in the art would appreciate that when using the materials of the present disclosure, it may be desirable to use more than two matrix materials. Specifically, as shown in FIG. 4B, first matrix region 420 (formed of a relatively tough material, for example) supports base of cutter 418, while a third matrix region 428 forms at least an outer surface of blade 412, on leading blade sidewall 412*b* as discussed in FIGS. 3A-D, the remainder of blade 412 being formed of second matrix region 424. Thus, it is clear that by using the materials and methods of the present disclosure, bits having various regions formed of materials specific to the needs of the particular regions may be obtained.

Figure 5:
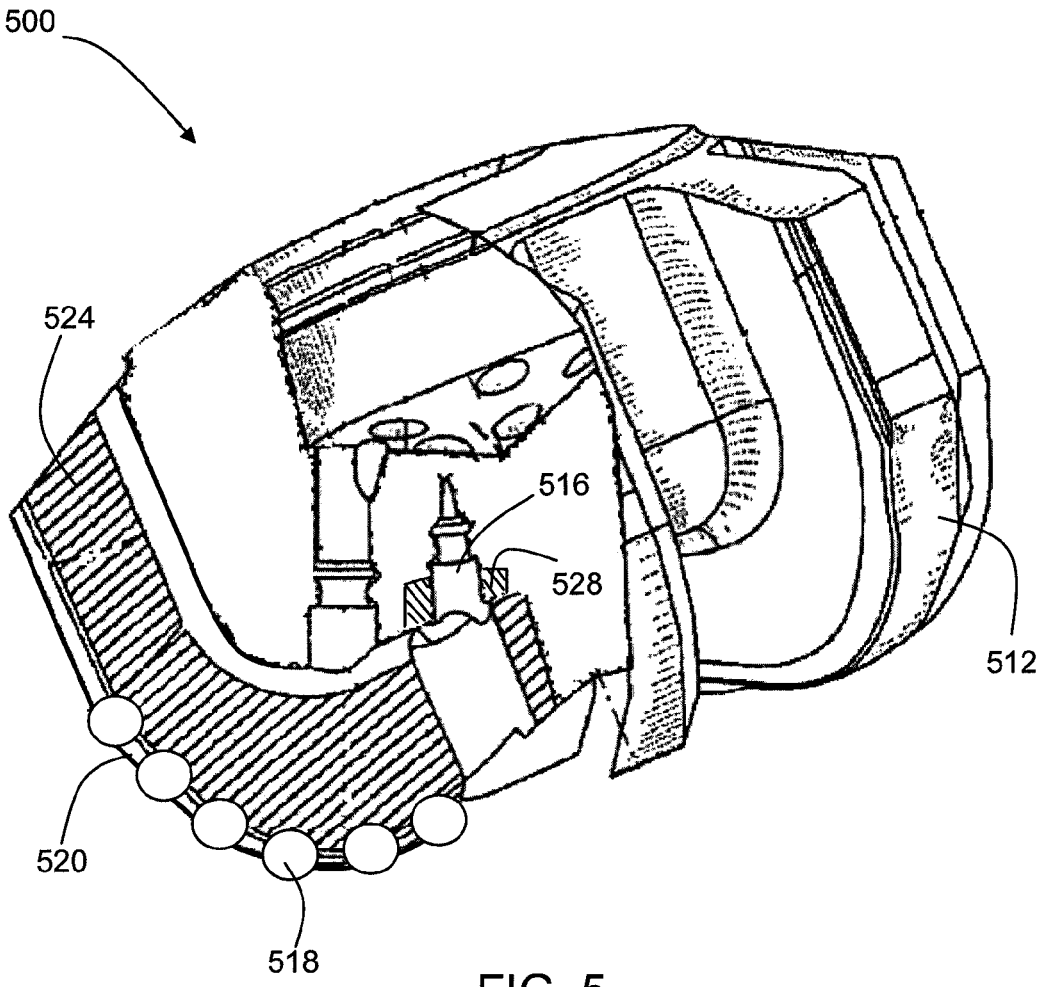
FIG. 5 shows a partial section view of a bit body in accordance with one embodiment.

Turning now to FIG. 5, yet another embodiment is shown. As shown in FIG. 5, a cutaway view of a bit 500 is shown. Bit 500 includes matrix bit body 510 having blades 512 extending therefrom and cutters 518 disposed on blades 512. Further, a first matrix region 520 forms an exterior surface of blades 512, with the core or inner portion of blades 512 being formed from second matrix region 524. Additionally, nozzles/ports 516 extend through bit body 510 to allow the flow of drilling fluid therethrough. As shown in FIG. 5, at least a portion of the area surrounding nozzles/ports 516 may be formed of a third matrix region 528. For such a bit, having three matrix regions, it may be desirable to have different material compositions for each region, depending on the types of failure typically experienced for those regions. Thus, because exterior surfaces and nozzle area typically encounter greater wear/erosion, first and third matrix regions 520, 528 may be provided with a harder or more wear/erosion resistant material as compared to the remaining portions of the bit body where greater toughness may be desired. Due to the highly abrasive, high flow of drilling fluid exiting nozzles 516, it may be desirable to provide third matrix region 528 with a matrix composition even more erosion resistant than first matrix region 520; however, in other embodiments, the two regions may be formed from the same material.

Thus, embodiments of the present disclosure provide a matrix drill bit having various portions of a bit body or blade of formed of a unique material, as compared to a neighboring regions of the bit body or blade. For example, the various portions may be formed from various combinations of type of hard particles and/or binder content. Further, in a particular embodiment, the different regions may be formed of materials to result in a hardness difference of at least 7 HRC and up to 50 HRC between two neighboring regions of the blade or bit body.

To achieve such difference, combinations of materials (and material properties) may be used in forming the bits of the present disclosure. It is specifically within the scope of the present disclosure that materials may be selected for the various regions of the bit to provide a differential in hardness/toughness, etc, depending on the loads and potential failure modes frequently experienced by that region of the bit. For example, in a particular embodiment, a base or inner region of a blade may be formed of a less hard or tougher material than the top height of the blade so as to provide greater support and durability to the blade, and reduce or prevent the incidents of blade breakage, while also achieving necessary wear resistance to the exterior surfaces.

The bits of the present disclosure have curved surfaces thereof (with a uniform thickness of material) or vertically oriented portions thereof (when formed in a mold) tailored with a varying material composition depending on the particular region of the bit body, unattainable by conventional powder metallurgy techniques. Manufacturing of a bit in accordance with the present disclosure may begin with the fabrication of a mold, having the desired body shape and component configuration, including blade geometry. Using conventional powder metallurgy, creating a curved or vertical surface region from a separate powder material (as compared to neighboring regions of the bit body) would be infeasible, if not impossible, as within a mold, the powders would too easily mix together. However, in accordance with embodiments of the present disclosure, a mixture of matrix material (for example, in a clay-like mixture) may be loaded into the mold, and place in the desired location of the mold, corresponding to the regions of the bit body desired to have different material properties. The other regions or portions of the bit body may be filled with a differing material, and the mold contents may be infiltrated with a molten infiltration binder and cooled to form a bit body. In embodiments where a unique matrix material is used to surround any portion of a cutter, it is also within the scope of the present disclosure, that such materials may be adhered to a displacement (used in the art to hold the place of cutters during bit manufacturing) prior to placement of the displacement in the mold. In a particular embodiment, during infiltration a loaded matrix material may be carried down with the molten infiltrant to fill any gaps between the particles. Further, one skilled on the art would appreciate that other techniques such as casting may alternatively be used.

In a particular embodiment, the materials (matrix and binder powder) may be combined as premixed pastes, which may then be packed into the mold in the respective portions of the mold, such that along the vertical and/or curved surfaces. By using a paste-like mixture of carbides, and metal powders, the mixture may possess structural cohesiveness beneficial in forming a bit having the material make-up disclosed herein. Additionally, the material may be formable or moldable, similar to clay, which may allow for the material to be shaped to have the desired thickness, shape, contour, etc., when placed or positioned in a mold. Further, as a result of the structural cohesiveness, when placed in a mold, the material may hold in place without encroaching the opposing portion of the mold cavity. To be moldable, such materials may have a viscosity of at least about 250,000 cP. However, in other embodiments, the materials may have a viscosity of at least 1,000,000 cP, at least 5,000,000 cp in another embodiment, and at least 10,000,000 cP in yet another embodiment. Further, the material may be designed to possess sufficient viscidity and adhesive strength so that it can adhere to the mold wall during the manufacturing process, without moving, specifically, it may be spread or stuck to a surface of a graphite mold, and the mold may be vibrated or turned upside down without the material falling. Thus, for a given material, the adhesive strength should be greater than the weight of the material per given contact area (with the mold) of the material. Once such materials are adhered to the particular desired vertical surfaces, the remaining portions of bit body may be filled using a matrix powder mixture. AIn a particular embodiment, a tough (and machinable) matrix material may be loaded from approximately 0.5 inches from the gage point to fill the mold. The entire mold contents may then be infiltrated using an infiltration binder (by heating the mold contents to a temperature over the melting point of the infiltration binder), as known in the art.

Use of such materials and methods may also allow for precision/controllability in the thickness of the layers/matrix regions. Specifically, by using a moldable material, the material may be shaped or cut into the desired shape or thickness using a sharp blade or rolling pin. Thus, such techniques may allow for formation of a layer having a relatively uniform thickness, i.e., within ±20% variance. However, in other embodiments, the thickness may have a variance within ±15%, ±10%, or ±5%. In yet other embodiments, a tapered layer may be desired, with precision of the taper (rate of taper) being similarly achievable. Additionally, depending on the location of the use of the moldable materials, the relative thickness may be selected. Desired minimum thickness may be based in part on the size of the carbide particles being used, the layer preferably being several carbide particles thick. In some embodiments, the layers may be at least 0.5 or 1 mm thick. However, the upper end of the thickness may be more particular to the particular region of the particular bit being formed and the type of material being used (e.g., relative brittleness). For example, the thickness of the matrix region forming the leading sidewall may broadly range up to (or beyond) the thickness of length of the cutters, whereas the thickness of the blade top may similarly range up to (or beyond) the diameter of the cutters; however, in particular embodiments, the layers may range from about 1 to 20 mm, 1 to 5 mm in other embodiments, and 3 to 10 in yet other embodiments.

This difference between the materials used in certain portions of a bit body may include variations in chemical make-up or particle size ranges/distribution, which may translate, for example, into a difference in wear or erosion resistance properties or toughness/strength. Thus, for example, different types of carbide (or other hard) particles may be used among the different types of matrix materials. One of ordinary skill in the art would appreciate that a particular variety of tungsten carbide, for example, may be selected based on hardness/wear resistance. Further, chemical make-up of a matrix powder material may also be varied by altering the percentages/ratios of the amount of hard particles as compared to binder powder. Thus, by decreasing the amount of tungsten carbide particle and increasing the amount of binder powder in a portion of the bit body, a softer portion may be obtained, and vice versa. In a particular embodiment, the matrix materials may be selected so that an outer surface of a blade (e.g., blade top, sidewall) or nozzle area may include relatively harder materials, and an inner core and/or cutter support area may include a tougher, softer material.

The matrix powder material may include a mixture of a carbide compounds and/or a metal alloy using any technique known to those skilled in the art. For example, matrix powder material may include at least one of macrocrystalline tungsten carbide particles, carburized tungsten carbide particles, cast tungsten carbide particles, and sintered tungsten carbide particles. In other embodiments non-tungsten carbides of vanadium, chromium, titanium, tantalum, niobium, and other carbides of the transition metal group may be used. In yet other embodiments, carbides, oxides, and nitrides of Group IVA, VA, or VIA metals may be used. Typically, a binder phase may be formed from a powder component and/or an infiltrating component. In some embodiments of the present invention, hard particles may be used in combination with a powder binder such as cobalt, nickel, iron, chromium, copper, molybdenum and their alloys, and combinations thereof. In various other embodiments, an infiltrating binder may include a Cu—Mn—Ni alloy, Ni—Cr—Si—B—Al—C alloy, Ni—Al alloy, and/or Cu—P alloy. In other embodiments, the infiltrating matrix material may include carbides in amounts ranging from 0 to 70% by weight in addition to at least one binder in amount ranging from 30 to 100% by weight thereof to facilitate bonding of matrix material and impregnated materials.

Further, with respect to particle sizes, each type of matrix material (for respective portions of a bit body) may be individually be selected from particle sizes that may range in various embodiments, for example, from about 1 to 200 micrometers, from about 1 to 150 micrometers, from about 10 to 100 micrometers, and from about 5 to 75 micrometers in various other embodiments or may be less than 50, 10, or 3 microns in yet other embodiments. In a particular embodiment, each type of matrix material (for respective bit body regions) may have a particle size distribution individually selected from a mono, bi- or otherwise multi-modal distribution.

One of ordinary skill in the art would appreciate that the type of matrix materials, i.e., the types and relative amounts of tungsten carbide, for example, may be selected based on the location of their use in a mold, so that the various bit body portions have the desired hardness/wear resistance for the given location. In addition to varying the type of tungsten carbide (as the various types of tungsten carbide have inherent differences in material properties that result from their use), the chemical make-up of a matrix powder material may also be varied by altering the percentages/ratios of the amount of hard particles as compared to binder powder. Thus, by decreasing the amount of tungsten carbide particle and increasing the amount of binder powder in a portion of the rib, a softer portion of the rib may be obtained, and vice versa.

Types of Tungsten Carbide

Tungsten carbide is a chemical compound containing both the transition metal tungsten and carbon. This material is known in the art to have extremely high hardness, high compressive strength and high wear resistance which makes it ideal for use in high stress applications. Its extreme hardness makes it useful in the manufacture of cutting tools, abrasives and bearings, as a cheaper and more heat-resistant alternative to diamond.

Sintered tungsten carbide, also known as cemented tungsten carbide, refers to a material formed by mixing particles of tungsten carbide, typically monotungsten carbide, and particles of cobalt or other iron group metal, and sintering the mixture. In a typical process for making sintered tungsten carbide, small tungsten carbide particles, e.g., 1-15 micrometers, and cobalt particles are vigorously mixed with a small amount of organic wax which serves as a temporary binder. An organic solvent may be used to promote uniform mixing. The mixture may be prepared for sintering by either of two techniques: it may be pressed into solid bodies often referred to as green compacts; alternatively, it may be formed into granules or pellets such as by pressing through a screen, or tumbling and then screened to obtain more or less uniform pellet size.

Such green compacts or pellets are then heated in a vacuum furnace to first evaporate the wax and then to a temperature near the melting point of cobalt (or the like) to cause the tungsten carbide particles to be bonded together by the metallic phase. After sintering, the compacts are crushed and screened for the desired particle size. Similarly, the sintered pellets, which tend to bond together during sintering, are crushed to break them apart. These are also screened to obtain a desired particle size. The crushed sintered carbide is generally more angular than the pellets, which tend to be rounded.

Cast tungsten carbide is another form of tungsten carbide and has approximately the eutectic composition between bitungsten carbide, $W_2C$, and monotungsten carbide, WC. Cast carbide is typically made by resistance heating tungsten in contact with carbon, and is available in two forms: crushed cast tungsten carbide and spherical cast tungsten carbide. Processes for producing spherical cast carbide particles are described in U.S. Pat. Nos. 4,723,996 and 5,089,182, which are herein incorporated by reference. Briefly, tungsten may be heated in a graphite crucible having a hole through which a resultant eutectic mixture of $W_2C$ and WC may drip. This liquid may be quenched in a bath of oil and may be subsequently comminuted or crushed to a desired particle size to form what is referred to as crushed cast tungsten carbide. Alternatively, a mixture of tungsten and carbon is heated above its melting point into a constantly flowing stream which is poured onto a rotating cooling surface, typically a water-cooled casting cone, pipe, or concave turntable. The molten stream is rapidly cooled on the rotating surface and forms spherical particles of eutectic tungsten carbide, which are referred to as spherical cast tungsten carbide.

The standard eutectic mixture of WC and $W_2C$ is typically about 4.5 weight percent carbon. Cast tungsten carbide commercially used as a matrix powder typically has a hypoeutectic carbon content of about 4 weight percent. In one embodiment of the present invention, the cast tungsten carbide used in the mixture of tungsten carbides is comprised of from about 3.7 to about 4.2 weight percent carbon.

Another type of tungsten carbide is macro-crystalline tungsten carbide. This material is essentially stoichiometric WC. Most of the macro-crystalline tungsten carbide is in the form of single crystals, but some bicrystals of WC may also form in larger particles. Single crystal monotungsten carbide is commercially available from Kennametal, Inc., Fallon, Nev.

Carburized carbide is yet another type of tungsten carbide. Carburized tungsten carbide is a product of the solid-state diffusion of carbon into tungsten metal at high temperatures in a protective atmosphere. Sometimes it is referred to as fully carburized tungsten carbide. Such carburized tungsten carbide grains usually are multi-crystalline, i.e., they are composed of WC agglomerates. The agglomerates form grains that are larger than the individual WC crystals. These large grains make it possible for a metal infiltrant or an infiltration binder to infiltrate a powder of such large grains. On the other hand, fine grain powders, e.g., grains less than 5 μm, do not infiltrate satisfactorily. Typical carburized tungsten carbide contains a minimum of 99.8% by weight of WC, with total carbon content in the range of about 6.08% to about 6.18% by weight.

Advantageously, embodiments of the present disclosure may provide for at least one of the following. Prior art techniques have not allowed for use of two different matrix material to be mixed in a mold due to lack of controllability of the powder locations in the mold during assembly, particularly along curved surfaces. Bits of the present disclosure may include use of harder materials in areas needing greater wear or erosion resistance to reduce erosion of the matrix material (the sign of which can cause a bit to be scrapped) while maintaining use of a slightly softer material on inner portions of the bit body to prevent the overuse of brittle materials (leading to cracking). Further, other bit regions such as cutter and/or nozzle areas may be tailored to for the needs of the particular region. For example, cutters may be surrounded by a tougher material to reduce incidents of cracking behind the cutter and/or cutter pockets may be formed from a material having a improved braze strength. Further, nozzle regions may be formed with a more erosion resistant material to prevent erosion of the matrix material due to the flow of drilling fluid thereby. Additionally, use of the moldable materials may allow for greater control and precision in the size, shape, thickness, etc., of these matrix regions which are unattainable using conventional techniques.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A method of manufacturing a drill bit including a bit body and a plurality of blades extending radially from the bit body, comprising:

disposing mold contents within a mold cavity, wherein the mold contents comprise a first matrix material and a second matrix material, and wherein disposing comprises:

adhering the first matrix material to at least a portion of the mold cavity corresponding to an outer surface of the bit body, wherein the first matrix material comprises an adhesive strength greater than a weight of the first matrix material per area of contact between the mold cavity and the first matrix material; and loading the second matrix material into the mold cavity, wherein the second matrix material is different than the first matrix material; and heating the mold contents to form the drill bit, wherein during the heating the first matrix material and the second matrix material are infiltrated with a molten infiltration binder.

2. The method of claim 1, wherein the at least a portion of the mold cavity corresponds to at least one a blade sidewall, nozzle outlet, cutter pocket, and blade top.

3. The method of claim 1, wherein the mold contents further comprise a third matrix material, and wherein disposing further comprises:

adhering the third matrix material to at least another portion of the mold cavity corresponding to an outer surface of the bit body, wherein the third matrix material is different than the first and the second matrix material.

4. The method of claim 1, wherein the first matrix material is adhered to the mold cavity to form a curved outer surface of substantially uniform thickness with an adjacent portion of the mold being unfilled or a vertical outer surface with a vertically adjacent portion of the mold being unfilled, and the second matrix material is loaded into the unfilled portions of the mold cavity adjacent to the first matrix material.

5. A method of manufacturing a drill bit including a bit body and a plurality of blades extending radially from the bit body, comprising:

disposing mold contents within a mold cavity, wherein the mold contents comprise a first matrix material and a second matrix material, and wherein disposing comprises:

loading the first matrix material in at least a portion of the mold cavity corresponding to a sidewall of at least one blade to have a controlled thickness, wherein the first matrix material comprises a moldable matrix material, wherein the moldable matrix material has a viscosity of at least 250,000 cP; and loading the second matrix material into the mold cavity, wherein the second matrix material is different than the first matrix material; and heating the mold contents to form the drill bit, wherein during the heating the first matrix material and the second matrix material are infiltrated with a molten infiltration binder.

6. The method of claim 5, wherein the controlled thickness is a uniform thickness having less than about a ±20% variance.

7. The method of claim 5, wherein the controlled thickness is tapered.

8. The method of claim 5, wherein the first matrix material is further loaded into a second portion of the mold cavity corresponding to at least one of a nozzle outlet, cutter pocket, and blade top.

9. The method of claim 5, wherein the mold contents further comprise a third matrix material, wherein the third matrix material is loaded into a second portion of the mold cavity corresponding to at least one of a nozzle outlet, cutter pocket, and blade top, and wherein the third matrix material is different than the first and the second matrix material.

10. A method of manufacturing a drill bit including a bit body and a plurality of blades extending radially from the bit body, comprising:

adhering a pre-formed moldable matrix material comprising a plurality of carbide particles to at least a portion of a mold cavity corresponding to an outer surface of the drill bit, wherein the pre-foinied moldable matrix material comprises an adhesive strength greater than a weight of the first matrix material per area of contact between the mold cavity and the first matrix material; and loading a second matrix material into the mold cavity, wherein the second matrix material is different than the pre-formed moldable matrix material; and heating the mold, the pre-formed moldable matrix material, and the second matrix material to form the drill bit, wherein during the heating the first matrix material is infiltrated with a molten infiltration binder.

11. The method of claim 10, wherein the mold contents further comprise a third matrix material, and wherein disposing further comprises:

adhering the third matrix material to at least another portion of the mold cavity corresponding to an outer surface of the bit body, wherein the third matrix material is different than the first and the second matrix material.

12. The method of claim 10, wherein the pre-formed moldable matrix material has a controlled thickness.

13. The method of claim 12, wherein the controlled thickness is a uniform thickness having less than about a ±20% variance.

14. The method of claim 12, wherein the controlled thickness is tapered.

15. The method of claim 12, wherein the pre-formed moldable matrix material is adhered to the mold cavity to form a curved outer surface of substantially uniform thickness with an adjacent portion of the mold being unfilled or a vertical outer surface with a vertically adjacent portion of the mold being unfilled, and the second matrix material is loaded into the unfilled portions of the mold cavity adjacent to the pre-formed moldable matrix material.

* * * * *